US006273559B1

(12) United States Patent
Vago et al.

(10) Patent No.: US 6,273,559 B1
(45) Date of Patent: Aug. 14, 2001

(54) SPRAYING PROCESS FOR AN ELECTRICALLY CONDUCTING LIQUID AND A CONTINUOUS INK JET PRINTING DEVICE USING THIS PROCESS

(75) Inventors: Stéphane Vago, Pont de l'Isére; Max Perrin, Etoile sur Rhòne, both of (FR)

(73) Assignee: Imaje S.A., Bourg les Valence Cedex (FR)

( * ) Notice: Subject to any disclaimer, the term of this patent is extended or adjusted under 35 U.S.C. 154(b) by 0 days.

(21) Appl. No.: 09/283,153

(22) Filed: Apr. 1, 1999

(30) Foreign Application Priority Data

Apr. 10, 1998 (FR) ..... 98 04561

(51) Int. Cl.[7] ..... B41J 2/06; B41J 2/09
(52) U.S. Cl. ..... 347/74
(58) Field of Search ..... 347/74–75, 6, 347/55, 78, 76, 77

(56) References Cited

U.S. PATENT DOCUMENTS

| | | | | |
|---|---|---|---|---|
| 4,346,387 | | 8/1982 | Hertz | 347/74 |
| 4,417,256 | * | 11/1983 | Fillmore et al. | 347/78 |
| 4,542,385 | * | 9/1985 | Jinnai et al. | 347/75 |
| 4,612,553 | * | 9/1986 | Kohler | 347/6 |
| 4,734,705 | * | 3/1988 | Rezanka et al. | 347/75 |
| 5,523,778 | | 6/1996 | Fickling | 347/74 |

FOREIGN PATENT DOCUMENTS 6-183003 * 7/1994 (JP) ..... 347/74

OTHER PUBLICATIONS

XP 000006578, Xerox Disclosure Journal. vol. 12 No. 6 Nov./Dec. 1987.
XP–002088885, Ink Jet Marking by Ultrasonic Jet Control, 8188 Journal of Imaging Technology, 12 (1986) Apr., No., 2, Springfield, Virginia, USA.
XP 000027460, Xerox Disclosure Journal, vol. 14 No. 3 May/Jun. 1989.

* cited by examiner

*Primary Examiner*—N. Le
*Assistant Examiner*—Anh T. N. Vo
(74) *Attorney, Agent, or Firm*—Pearne & Gordon LLP

(57) ABSTRACT

One or several jets (14) of an electrically conducting liquid such as ink, are emitted at a given speed $V_j$ and are stimulated so as to form drops (22, 24) at a frequency F, at two break off points (C, L) separated by a distance ΔD less than the wavelength λ of the jet, defined by the relation $\lambda = V_j/F$. Two contiguous areas are created (20) in the vicinity of these two break off points (C, L), and the potential of these two areas is brought up to constant electrical potentials with opposite signs (V1, V2). Different quantities of electric charge are thus applied on the drops (22, 24), which are relatively constant even if the break off points should vary. A deflection device (30) then deviates the drops to be recycled (24) and the drops to be printed (22) depending on their charge, which depends on their break off point.

11 Claims, 3 Drawing Sheets

SPRAYING PROCESS FOR AN ELECTRICALLY CONDUCTING LIQUID AND A CONTINUOUS INK JET PRINTING DEVICE USING THIS PROCESS

TECHNICAL FIELD

This invention relates to a process for projecting an electrically conducting liquid in the form of at least one continuous stimulated jet.

The invention also relates to a multi-nozzle printing device embodying this process.

A printing device conform with the invention may be used in any industrial domain related to marking, coding, addressing and industrial decoration.

STATE OF THE ART

In the current state of the art, there are two main printing technologies using stimulated continuous ink jets. These processes are the deviated continuous ink jet technique and the binary continuous ink jet technique.

According to the deviated continuous ink jet technique, pressurized electrically conducting ink is discharged through a calibrated nozzle. The ink jet thus formed is broken off at regular time intervals always at the same point in space, under the action of a periodic stimulation device. This forced fragmentation of the ink jet is usually induced by periodic vibrations of a piezoelectric crystal on the inlet side of the nozzle. Starting from this break off point, the continuous jet is transformed into a stream of identical and uniformly spaced ink drops. A first group of electrodes is located close to the break off point, the function of which is to selectively transfer a variable and predetermined quantity of electric charge to each drop in the jet. All drops in the jet then pass through a second group of electrodes, in which there is a constant electric field. Each drop is then deflected proportionally to the electric charge that has already been assigned to it, and which directs it towards a specific point on a medium to be printed. Undeflected drops are recovered in a gutter and are recycled to an ink circuit.

In ink jet printers based on this technique, a specific device is usually provided to maintain constant synchronization between instants at which the jet is broken off and instants at which drop charge signals are applied.

This technology is characterized mainly by the fact that a variable quantity of electric charge is selectively transferred to each drop in the jet, such that multiple deflection levels are created. Due to this characteristic, a single nozzle can print an entire pattern (character or graphic pattern) in segments (lines of points with a given width). The changeover from one segment to the next takes place by moving the print medium in front of the printing device, continuously and perpendicular to the segments.

Several single nozzle printing devices (usually two to four) can be grouped within the same housing, for applications requiring a slightly greater print width.

Multi-nozzle printing devices have to be used when print widths become large. Document EP-A-0 512 907 describes a multi-nozzle (eight nozzles) printing device using the deviated continuous ink jet technology. Even greater print widths can be obtained by putting several multi-nozzle printing devices together.

Stimulated continuous ink jet printing devices using the binary continuous jet technique are different from printing devices making use of the deviated continuous jet technique mainly due to the fact that only a predetermined quantity of electric charge can be transferred to each drop in the jet, on request. Therefore only one value of the drop deflection is created. Consequently, multi-nozzle printing devices are necessary to print characters or patterns, in which the center-to-center distance between the nozzles usually corresponds to the spacing between impacts on the medium to be printed. In general, drops to be used for printing ("drops to be printed" in the rest of the text) are the undeflected drops. This technique is particularly suitable for high speed printing applications such as addressing, printing of high resolution color prints, etc.

In printing devices making use of a binary continuous ink jet, some components of groups of charging and deflection electrodes can be made common to these two groups of electrodes. In all cases, electrodes dedicated to charging drops in each jet must be controlled individually, at the same frequency at which the drops are formed and at voltages of up to 350 V.

Major cost and design problems arise with the manufacturing of nozzles and electrodes for a multi-nozzle printing device operating according to the binary continuous ink jet technique, and with their positioning when a very fine pitch is necessary.

Cost problems are due to the large number of charging electrodes and the large number of high voltage electronic circuits connected to these electrodes, which result in large and complex connections.

Design problems are related to the very dense high voltage connections close to the jets, which cause undesirable crosstalk. The only way to reduce the effect of this crosstalk on the print quality is to reduce the drop usage ratio, and consequently the print speed.

In the article entitled "Binary Continuous Thermal Ink Jet Break off Length Modulation" by Donald J. DRAKE, published in the Xerox Disclosure Journal, Volume 14, No. 3, May–June 1989, a multi-nozzle binary continuous jet printing device is suggested in which the design has been modified to overcome the disadvantages mentioned above.

In accordance with the conventional binary continuous jet technology, this article proposes to use two electrode groups, each of which is formed by a flat electrode. However in this case, each electrode is common to all jets and a constant electric voltage is applied to it. The drops to be printed and the drops to be recycled are selected by individual control of the stimulation of each ink jet on the print head. Consequently, an individual stimulation device is provided for each jet.

With this layout, the connections associated with the stimulation devices are located on the inlet side of the nozzles and therefore are not close to the jets. Furthermore, the voltages carried on the connections are less than voltages required for charging the drops. Therefore the effects of crosstalk are reduced.

According to the article by Donald J. DRAKE, a low level or high level stimulation signal is applied to each of the jets on request. The point at which the jet breaks when a low level stimulation signal is applied is further from the nozzle than when a high level stimulation signal is applied to the jet.

In the first case, the jet break off point is located facing the first electrode, or the charging electrode, which is at a constant voltage $V_c$. The drop that detaches at this instant then carries a charge Q1 and is subjected to a deflection equal to an angle δ1 within the field created by the second electrode, or deflection electrode, which is kept at a constant voltage $V_d$. This drop is recovered by the gutter and is recycled to the printing device ink circuit.

When the break distance is shorter because a high level stimulation signal is applied on the jet, the jet breaks at a point slightly before the charged electrode. The charge Q2 carried by the drop is then smaller than in the previous case. The deflection δ2 induced by the deflection plane is also smaller. The drop then avoids the gutter and reaches the medium to be printed.

In this article, the difference between two jet stimulation levels is such that the distance d between jet break off points for each of the two levels is equal to the wavelength λ of the stimulated jet, i.e. the stream of drops. The value λ is provided by the ratio of the speed $V_j$ of the jet to the frequency F of the stimulation signal, $\lambda=V_j/F$.

However, there are three serious disadvantages to the operating method and design suggested in this article, which limit the extent to which this process can be applied to continuous ink jet printers.

The first disadvantage is due to the fact that the distance d between the two jet break off points is equal to the wavelength λ of the stream of drops. This makes it very difficult to use the jet when long break-short break transitions occur. It is found that when a drop to be printed is followed by a drop to be recycled, the condition d=λ theoretically results in simultaneous detachment of the two drops. The kinetics of charge transfers is then different from the kinetics associated with a short break-long break transition, which can induce different trajectories. Furthermore, any fluctuation in either of the break distances, which is inevitable in a real embodiment of the process, will cause a change to the jet operating conditions. For example, if d becomes slightly greater than λ, two drops will temporarily be combined during long break-short break transitions. A redistribution of the induced charges, which is apparently difficult to determine in advance, will take place and the trajectory of the drop to be printed will be changed.

The second disadvantage of the process described in the article by Donald J. DRAKE is a result of the proposed layout of electrodes, which imposes a short distance between the surface of the jet and the charging electrode (of the order of the jet diameter) in order to achieve satisfactory selection of print drops. There are several difficulties in the manufacture and use of this type of geometry within a multi-nozzle continuous jet printing device.

Firstly, a transient phase is necessary when starting this type of printing device for ink jets passing through the nozzles, during which aerodynamic braking is predominant. In particular, an ink volume is formed at the end of each jet, which is larger than the size of drops formed during steady state conditions and the jet trajectory is momentarily modified.

Therefore the charging electrode placed in the immediate vicinity of the jet center line tends to become dirty when the jets are being started. This effect is made inevitable by the angular dispersion of each jet, itself caused by the values of the precision and repeatability achieved when the nozzles are manufactured. It strongly disturbs operation of the printing device and limits its reliability. The charging electrode then has to be cleaned.

Furthermore, under steady state conditions, any fluctuation in the trajectory of jets around their center line (for example due to the temporary presence of an impurity in the jet ejection pipe) can also deviate the jet slightly and cause dirt to collect on the charging electrode located immediately adjacent to the jets, which usually causes short circuits between the jet and the electrode.

Finally, the geometry of the charging electrode described in the previous article, which induces the application of quantities of electric charge on printed drops and on unprinted drops, is a third disadvantage. These charge quantities, and consequently drop deflection levels, vary in a strictly monotonous manner with the positions of the break off points within the electric field created by the charging electrode. This means that the print quality of a multi-nozzle printing device incorporating this type of charging electrode depends directly on the precision with which the short break off point is positioned and regulated for all jets in the printing device. Each break off point different from this short break off point will result in a different impact point on the print medium. Management and control of this type of constraint is technically extremely difficult, and also would significantly increase the cost of a printing device operating in this manner.

Document US-A-4 638 328 proposes to replace piezoelectric stimulation elements by thermo-resistive elements generating temperature disturbances.

Furthermore, document US-A-4 220 958 describes an ink jet stimulation process in which the jet disturbance is performed by electro-hydrodynamic (EHD) excitation. The EHD stimulation device proposed in this document is composed of one or a set of several electrodes placed close to the jet on the outlet side of the jet, the length of each electrode being approximately equal to λ/2.

DISCLOSURE OF THE INVENTION

The main purpose of the invention is a process for projecting electrically conducting liquid using the binary continuous jet technique described in the article by Donald J. DRAKE mentioned above, without the disadvantages related to this technique.

More precisely, the invention relates to a process for projecting liquid by a continuous jet in which the process for charging drops output from the jets is controlled regardless of the sequence of drops emitted, and the trajectory of printable drops is not a strictly monotonous function of the position of the break off point within the charging device.

According to the most general definition of the invention, this result is obtained by means of a process for projecting an electrically conducting liquid in which:

- at least one continuous liquid jet is emitted at a constant speed $V_j$;
- the jet is stimulated on request, so as to break it at two predetermined distinct break off points to form liquid drops at a given emission frequency F;
- different electric charge quantities are applied to the drops, depending on their break off points; and then
- the same electric field is applied on all drops, so as to only deviate drops formed at a relatively distant first break off point;

characterized by the fact that the jet is stimulated such that the two break off points are separated by a distance ΔD less than the wavelength λ of the jet, defined by the relation $\lambda=V_j/F$, and approximately the same quantity of charge is applied to all drops formed within an area centered on the second break off point and with a length equal to approximately λ/4.

According to a preferred embodiment of the invention, the said different quantities of electric charge are applied to the drops by creating two contiguous areas located close to the two break off points, and by applying constant electrical potentials with opposite signs to these two areas.

This can be done by passing the jet in sequence between two pairs of electrodes oriented parallel to the jet and sized such that the break off points are located between the said electrodes, and applying constant electric voltages with opposite signs to the two pairs of electrodes.

In this case, in order to avoid disadvantages related to the immediate proximity between the jet surface and the charge plane, it is advantageous to place each electrode at a distance from the center line of the jet equal to at least twice its diameter.

Preferably, several continuous liquid jets are emitted simultaneously and parallel to each other, each jet is stimulated separately, the said different quantities of electric charge are applied to the drops in all jets simultaneously, and the same electric field is applied simultaneously to all these drops.

Another purpose of the invention is a printing device by continuous ink jets, comprising:

- a pressurized reservoir equipped with several nozzles capable of simultaneously emitting several continuous ink jets parallel to each other at a given speed $V_j$;
- an individual binary stimulation means for each jet capable of fragmenting the jet on request at two distinct predetermined break off points, to form ink drops at a given emission frequency F;
- a charging means common to several ink jets, to apply different quantities of electric charge to the ink drops, depending on their break off points;
- a deflection means common to all ink jets, to apply the same electric field to the drops, so as to deviate only drops formed at one of the first break off points relatively remote from the nozzles; and
- a recycling gutter returning deviated drops towards the pressurized reservoir;

characterized by the fact that the individual means of binary stimulation of each of the jets is controlled by predetermined voltage levels such that the two break off points are separated by a distance strictly less than the jet wavelength $\lambda$ defined by the relation $\lambda=V_j/F$, the charging means being capable of applying approximately the same charge quantity onto all drops formed in an area centered on the second break off point and with a length equal to approximately $\lambda/4$.

According to a first embodiment of the invention, the individual binary stimulation means of each of the jets comprises a piezoelectric or thermo-resistive element placed in the pressurized reservoir and controlled individually by an external electronic circuit.

According to a second embodiment of the invention, the individual binary stimulation means of each of the jets comprises two thermo-resistive elements placed in the pressurized reservoir, one external electric circuit continuously supplying a periodic electric power supply signal to the first of the thermo-resistive elements corresponding to the first break off point, and on request, a complementary electric power supply signal to the second thermo-resistive element corresponding to the second break off point.

Finally, according to a third embodiment of the invention, the individual binary stimulation means for each jet comprises an individual transducer placed in the pressurized reservoir and at least one common hydrodynamic excitation electrode placed close to the jets on the outlet side of the nozzle, an external electric circuit continuously outputting a periodic electric signal for the power supply of the electro-hydrodynamic excitation electrode corresponding to the first break off point, and on request, a complementary electric power supply signal to the individual transducer corresponding to the second break off point.

BRIEF DESCRIPTION OF THE DRAWINGS

We will now describe different embodiments of the invention as non-restrictive examples, with reference to the attached drawings in which.

DETAILED DESCRIPTION OF SEVERAL PREFERRED EMBODIMENTS

Figure 1:
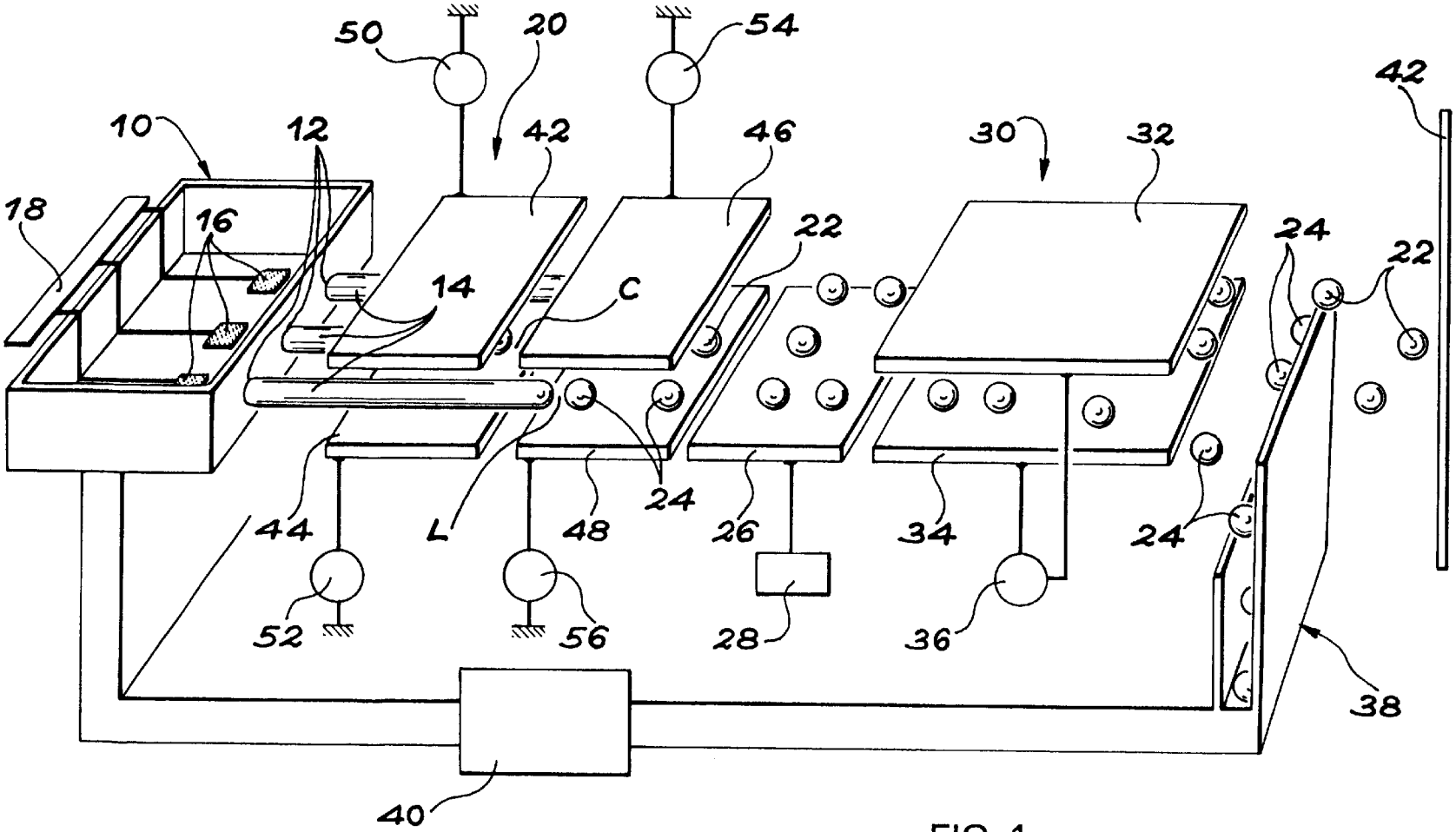
FIG. 1 is a perspective view that diagrammatically shows a continuous ink jet print device according to the invention.

FIG. 1 diagrammatically shows a continuous ink jet printing device making use of the process for projecting an electrically conducting liquid conform with the invention.

The device comprises a pressurized reservoir 10 equipped with several calibrated nozzles 12 (three in the figure) from which ink jets 14 parallel to each other escape at a given speed $V_j$, and at a constant spacing between them.

An individual binary stimulation means 16 is associated with each ink jet 14, placed in reservoir 10 and individually controlled by an external electronic circuit 18. On request, each binary stimulation means 16 fixes the location at which each jet 14 breaks at a short break off point C relatively close to nozzle 12, or at a long break off point L further away from this nozzle. The drops formed at points C and L are denoted references 22 and 24 respectively, drops 22 and 24 are all emitted at a given emission frequency F.

A charging means 20 which will be described in more detail later is placed close to break off points C and L. This charging means 20 is common to all ink jets 14. It applies different charge quantities to drops 22 and 24, depending on their break off points.

On the output side of the charging means 20, the printing device comprises a sensor 26 designed to measure the speed of ink jets 14. This sensor 26 is connected to an electronic circuit 28 that processes data collected by the sensor. The circuit 28 is connected to a regulation loop (not shown) regulating the speed of jets 14, using an arrangement well known to an expert in the subject. To simplify the figure, the sensor 26 and its associated circuit are not shown in FIGS. 2A to 4.

On the output side of sensor 26, the printing device comprises a deflection means 30 that applies the same constant electric field to ink drops 22 and 24, previously electrically charged in the charging means 20. This deflection means 30 comprises two flat electrodes 32 and 34 common to all ink jets 14. These electrodes 32 and 34 are laid out on each side of the streams of ink drops 22 and 24, and a constant voltage is applied between them by a power supply circuit 36. The deflection means 30 directs the charged drops 24 towards a gutter 38 that recycles them to the device main ink circuit 40. The trajectory of the other drops 22, at approximately zero charge, is unaffected by the deflection means 30 such that these uncharged drops come into contact with medium 42 to be printed.

The charging means 20 comprises two groups of flat electrodes 42, 44 and 46, 48 respectively, the electrodes in each group being placed on each side of jets 14. The two groups of electrodes are separated from each other by a distance D (FIG. 2A) parallel to the jet center lines. The total length of the two groups of electrodes parallel to the jet axes is denoted S. As diagrammatically shown in FIG. 1, the supply circuits 50 and 52 apply the same constant voltage V1 to the two electrodes 42 and 44 in the first group of electrodes, and power supply circuits 54 and 56 apply the same constant voltage V2 with an opposite sign to V1 to the two electrodes 46 and 48 in the second group of electrodes. Two contiguous areas are thus created adjacent to the break off points C and L respectively, held at constant electrical potentials with opposite signs.

Figure 2A:
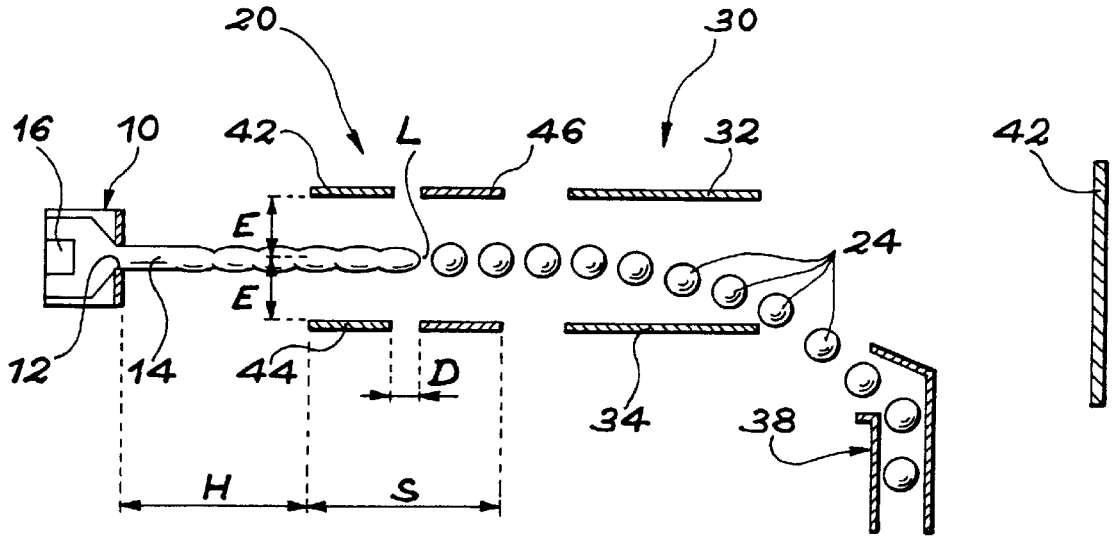
FIGS. 2A and 2B are side views that very diagrammatically illustrate the charging and deflection processes in the device in FIG. 1, for drops intended to be recycled and for drops to be printed respectively.
Figure 2B:
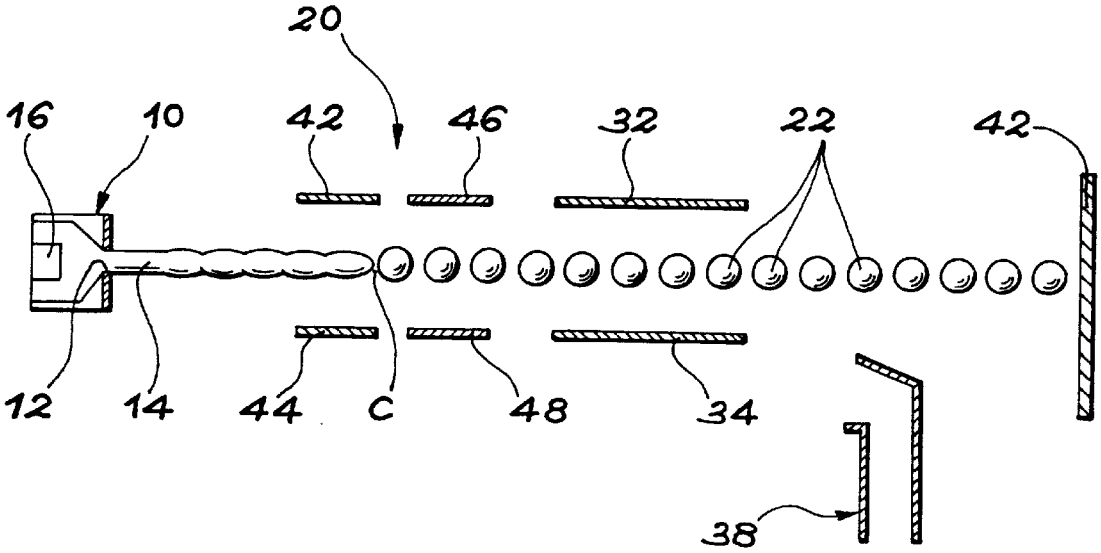

As illustrated more precisely in FIGS. 2A and 2B, electrodes 42 and 44 in the first group of electrodes are laid out symmetrically on each side of jets 14 and each are placed at a distance E from the jet center lines. Preferably, this distance E is equal to or greater than twice the diameter $d_j$ of the jets 14. This characteristic prevents the electrodes from getting dirty when the jets are being started, and also under steady state conditions in the presence of an impurity in the ejection pipe. The reliability of the printing device is thus improved.

Electrodes 46 and 48 in the second group of electrodes are also laid out symmetrically on each side of the jets 14 and at the same distance E from their center lines.

When the printing device is working, a drop 24 which is not to be printed on the medium 42 to be printed is selected by controlling the individual binary stimulation means 16 of the corresponding jet 14 by an electric signal, the level $V_1$ of which is determined in order to force the jet to break at the predetermined long break off point L, within charging means 20.

A drop 22 to be printed on the medium 42 is selected by controlling the individual binary stimulation means 16 of the corresponding jet by an electric signal at a level $V_c$ that will force the jet to break at the predetermined short break off point C also within charging means 20.

The distance ΔD between the two break off points C and L according to the invention is less than the wavelength λ of the stimulated jets. The value of the wavelength λ is provided by the relation $\lambda=V_j/F$. Any risk of temporarily combining two drops during long break-short break transitions is thus avoided. Consequently, any modifications to the trajectory of the drop to be printed are eliminated.

An arbitrary sequence of drops 24 not intended for printing or drops 22 intended for printing is created by generating a signal including the corresponding level sequence $V_c$ or $V_1$, on the individual stimulation means 16 for each jet and at the selected drop emission frequency F.

If the charging means 20 is placed at a distance H (FIG. 2A) from nozzles 12, for which the break off points C and L are between H and H+S (in other words within the drop charging means 20), the values of H, S, D, E, V1 and V2 are fixed such that:

- the charge induced on the drops to be recycled 24 detached from the jet at the long break off point L, is such that the constant electric field generated by the deflection means 30 bends the trajectory of these drops towards the gutter 38 (FIG. 2A);
- the charge induced on the drops to be printed 22 detached from the jet at the short break off point C, and in the area centered around this pound and with a length equal to approximately λ/4, is such that the constant electric field produced by the deflection means 30 does not modify the trajectory of these drops, which can then reach the print medium 42 (FIG. 2B).

Therefore, the trajectory of the drops to be printed 22 is not a strictly monotonous function of the position of the break off point within the charging device. On the contrary, the same impact point is guaranteed on the print medium despite any fluctuations in the short break off point C. The print quality is thus guaranteed without any particular technical difficulty or increase in cost.

As a non-restrictive example, the length S of the charging means 20 may be less than 2.5 mm, the tension V1 applied to electrodes 42 and 44 is equal to 300 V, and the voltage V2 applied to electrodes 46 and 48 is equal to −300 V. Each of the jets 14 may have a diameter of 35 82 m, for example, a speed of 24 m/s and a stimulation frequency equal to 125 kHz.

In the first embodiment of the invention illustrated diagrammatically in FIGS. 1, 2A and 2B, each of the individual binary stimulation means 16 is composed of a piezoelectric element placed in the reservoir 10 and individually controlled by the external electronic circuit 18. The number of piezoelectric elements is equal to the number of nozzles 12 on the print head.

As a variant, each of the piezoelectric elements forming part of the individual binary stimulation means 16 may be replaced by a thermo-resistive element that generates thermal disturbances. Document US-A-4 638 328 contains more details about this type of thermo-resistive elements, and about their operation and of manufacture.

When each individual binary stimulation means 16 is composed of a single thermo-resistive element associated with each nozzle 12 in the print head, this element is powered by an electric signal composed of a sequence of voltages $V_c$ and $V_1$, corresponding to the pattern that is to be printed.

Figure 3:
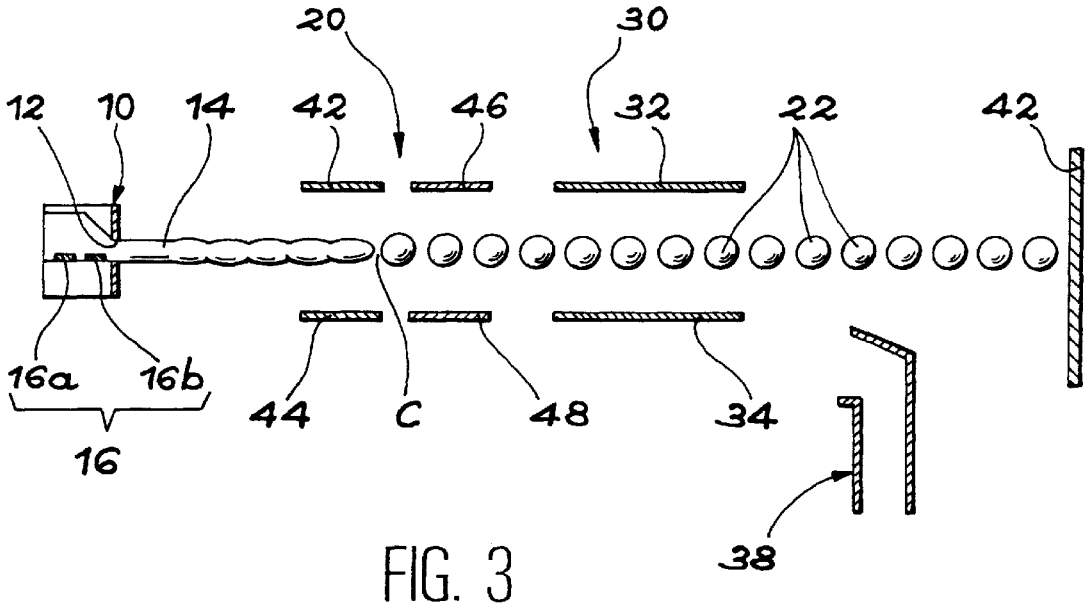
FIG. 3 is a sectional view comparable to FIGS. 2A and 2B illustrating a second embodiment of the invention, in which each individual binary stimulation means comprises two thermo-resistive elements.

According to a second embodiment of the invention illustrated diagrammatically in FIG. 3, each of the individual binary stimulation means 16 comprises two thermo-resistive elements 16*a* and 16*b* associated with each nozzle 12 on the print head.

The first element 16*a* is powered continuously by a periodic electric signal with an amplitude $V_1$. Therefore when this is the only element to be powered, the jet is broken off at the point L furthest away from the nozzle.

The second element 16*b*, located upstream or downstream from the first element depending on the case, is only activated when a drop 22 is to be printed. It then receives an electric signal, preferably a voltage pulse, for which the amplitude and phase shift with respect to the periodic signal applied to the first element 16*a* force the jet break off point to be moved to point C closest to the nozzle.

Figure 4:
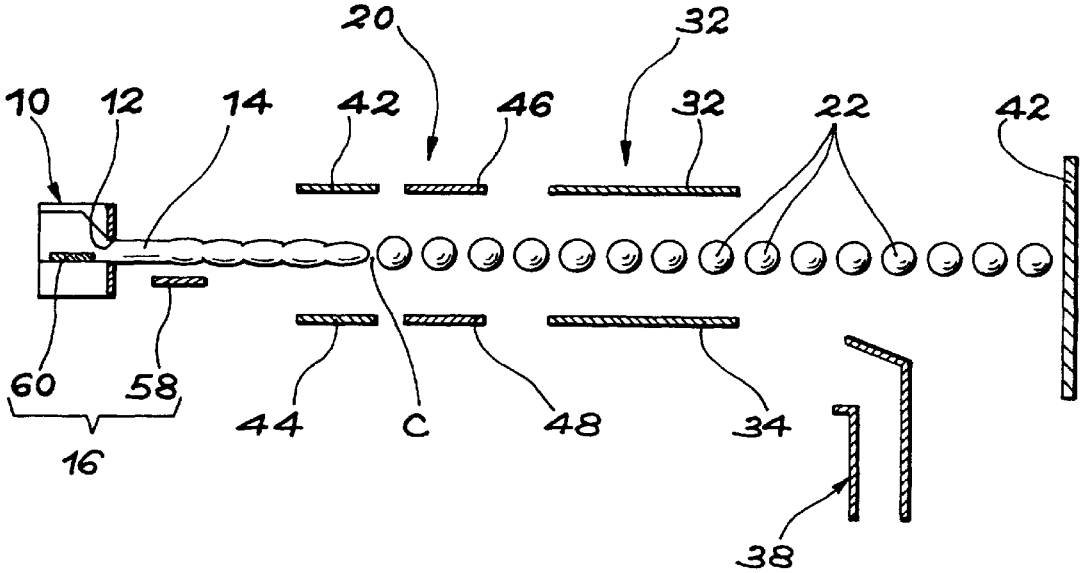
FIG. 4 is a schematic sectional view comparable to FIGS. 2A, 2B and 3, illustrating a third embodiment of the invention in which each individual binary stimulation means comprises a thermo-resistive element and a common EHD stimulation device.

A third embodiment of individual binary stimulation means for each of the jets 14 is shown diagrammatically in FIG. 4.

In this case, each individual binary stimulation means 16 comprises an electrode 58 placed immediately on the outlet side of nozzles 12 and common to all jets. This electrode 58 forms a stimulation device by electrodynamic excitation (EHD). Document US-A-4 220 958 describes a device of this type and its operation. This electrode 58, the length of which is equal to approximately λ/2, fixes the jet break off point at the furthest point from the nozzles L, when no other stimulation is applied on the jets.

Each individual binary stimulation means 16 also comprises an individual transducer 60, preferably of the thermo-resistive type, associated with each jet inside the reservoir 10. Transducers 60 are only active to move break off points at point C closest to the nozzle when a drop 22 is to be printed. The embodiment shown in FIG. 4 extends the life of the thermo-resistive transducers compared with previously described embodiments, by reducing their use.

Note that the process implemented by the described printing device may be applied to selective projection of any electrically conducting liquid.

Compared with the continuous jet liquid projection process according to prior art, this process can give better control over the charging process of drops produced by jets regardless of the sequence of drops emitted. Furthermore, electrodes in the drop charging device are not located in the immediate vicinity of the jets. Furthermore, the trajectory of the drops to be printed is not a strictly monotonous function of the position of the break off point within the charging device.

As has already been mentioned, a multi-nozzle ink jet printer made according to the invention can be used in all applications related to industrial marking and coding. Addressing, which requires high speed and print width, is also another application in which the invention may be used. Furthermore, the lack of individual electrodes facing the jet makes it possible to increase the number of nozzles per unit length along the printing device reservoir. This means that the invention can be applied to industrial decoration which requires high resolution in addition to high printing speed.

What is claimed is:

1. Process for projecting an electrically conducting liquid comprising the steps of:

emitting at least one continuous liquid jet at a constant speed $V_j$;

stimulating the jet on request, so as to break it at two predetermined distinct break off points to form liquid drops at a given emission frequency F;

applying different electric charge quantities to the drops, depending on their break off points; and then applying a same electric field on all drops, so as to only deviate drops formed at one of the first of the said break off points which is relatively distant;

and in which the jet is stimulated such that the two break off points are separated by a distance $\Delta D$ strictly less than a wavelength $\lambda$ of the jet, defined by the relation $\lambda=V_j/F$, and approximately the same quantity of charge is applied to all drops formed within an area around the second of the said break off points, said area centered on the second break off point and having a length equal to approximately $\lambda/4$.

2. Process according to claim 1, in which the said different quantities of electric charge are applied to the drops by creating two contiguous areas located in the vicinity of the two break off points, and by applying constant electrical potentials with opposite signs to these two areas.

3. Process according to claim 2, in which the jet is passed successively between two pairs of electrodes laid out parallel to the jet and sized such that the two break off points are located between the said electrodes, and by applying constant electrical voltages with opposite signs onto the two pairs of electrodes.

4. Process according to claim 3, in which each electrode is placed at a distance from the center line of the jet equal to at least twice the jet diameter.

5. Process according to claim 1, in which several continuous liquid jets parallel to each other are emitted simultaneously, each jet is stimulated separately, the said different quantities of electric charge are applied simultaneously to the drops of all the jets, and then the same electric field is applied simultaneously to the drops.

6. Continuous ink jet printing device comprising:

a pressurized reservoir equipped with several nozzles capable of simultaneously emitting several continuous ink jets parallel to each other, at a given speed $V_j$;

an individual means of binary stimulation of each jet, capable of fragmenting these jets on request, at two distinct predetermined break off points, to form ink drops at a given emission frequency F;

a charging means common to all ink jets, to apply different quantities of electric charge to the ink drops, depending on the break off points;

a deflection means common to the several ink jets, to apply a same electrical field to the drops, in order to deviate only the drops formed at the first of the break off points relatively far from the nozzle; and a recycling gutter for drops deviated towards the pressurized reservoir;

in which the individual binary stimulation means for each jet is controlled by predefined voltage levels such that the two break off points are separated by a distance strictly less than a wavelength $\lambda$ of the jet defined by the relation $\lambda=V_j/F$, the charging means being capable of applying approximately the same quantity of charge on all drops formed within an area around the second of the said break off points, said area centered on the second break off point and having a length equal to approximately $\lambda/4$.

7. Device according to claim 6, in which the charging means comprises two pairs of electrodes oriented parallel to the jets, and sized so that the break off points are located between the said electrodes, and means of applying constant electrical voltages with opposite signs on the two pairs of electrodes.

8. Device according to claim 7 in which the electrodes are flat and are placed at a distance of at least twice the jet diameter from the center line of each jet.

9. Device according to any one of claims 6 to 8, in which the individual binary stimulation means for each jet comprises a piezoelectric or thermo-resistive element placed in the pressurized reservoir and controlled individually by an external electronic circuit.

10. Device according to any one of claims 6 to 8, in which the individual binary stimulation means for each jet comprises two thermo-resistive elements placed in the pressurized reservoir, an external electrical circuit continuously outputting a periodic electrical power supply signal to one of the first thermo-resistive elements corresponding to the first break off point, and on request, a complementary electrical power supply signal to the second thermo-resistive element, corresponding to the second break off point.

11. Device according to any one of claims 6 to 8, in which the individual binary stimulation means for each jet comprises an individual transducer placed in the pressurized reservoir and at least one common electro-hydrodynamic excitation electrode placed in the vicinity of the jets or on the outlet side of the nozzle, an external electrical circuit continuously outputting a periodic electric power supply signal for the electro-hydrodynamic excitation electrode corresponding to the first break off point, and on request, a complementary electric power supply signal for the individual transducer corresponding to the second break off point.

* * * * *